US008350979B2

(12) United States Patent
Kim et al.

(10) Patent No.: US 8,350,979 B2
(45) Date of Patent: Jan. 8, 2013

(54) ORGANIC LIGHT EMITTING DISPLAY DEVICE

(75) Inventors: Mun-su Kim, Suwon-si (KR); Sung-yun Kim, Suwon-si (KR); Dong-ho Kim, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1143 days.

(21) Appl. No.: 12/124,022

(22) Filed: May 20, 2008

(65) Prior Publication Data

US 2008/0291612 A1 Nov. 27, 2008

(30) Foreign Application Priority Data

May 23, 2007 (KR) ..... 10-2007-0050322

(51) Int. Cl.
*G02F 1/1333* (2006.01)

(52) U.S. Cl. ..... 349/58; 349/149

(58) Field of Classification Search ..... 349/58, 349/65; 362/632–634; 361/679.21–679.3
See application file for complete search history.

(56) References Cited

U.S. PATENT DOCUMENTS

| | | | | |
|---|---|---|---|---|
| 5,161,028 | A * | 11/1992 | Kawata et al. | 348/837 |
| 6,593,979 | B1 | 7/2003 | Ha et al. | |
| 2001/0035931 | A1 | 11/2001 | Kumagai et al. | |
| 2002/0105605 | A1 | 8/2002 | Huang et al. | |
| 2002/0109802 | A1 * | 8/2002 | Cheng et al. | 349/58 |
| 2004/0201346 | A1 * | 10/2004 | Pai | 313/503 |
| 2005/0270800 | A1 | 12/2005 | Kim et al. | |
| 2005/0280750 | A1 * | 12/2005 | Cho et al. | 349/58 |
| 2006/0028608 | A1 * | 2/2006 | Youn et al. | 349/153 |
| 2006/0139271 | A1 * | 6/2006 | Okuda | 345/88 |
| 2007/0002206 | A1 * | 1/2007 | Shirai | 349/58 |
| 2007/0064378 | A1 | 3/2007 | Lo et al. | |
| 2008/0074036 | A1 | 3/2008 | Wang et al. | |
| 2008/0297041 | A1 | 12/2008 | Park | |

FOREIGN PATENT DOCUMENTS

| | | | |
|---|---|---|---|
| JP | 2002-182209 | | 6/2002 |
| JP | 2005-121929 | | 5/2005 |
| KR | 1020000041544 | | 7/2000 |
| KR | 1020010036079 | A | 5/2001 |
| KR | 1020010077361 | A | 8/2001 |
| KR | 1020010094205 | A | 10/2001 |
| KR | 1020020002985 | | 1/2002 |
| KR | 20-0348836 | | 4/2004 |
| KR | 100556031 | | 2/2006 |
| KR | 1020060060218 | | 6/2006 |
| KR | 1020060101265 | | 9/2006 |
| KR | 100645694 | | 11/2006 |

OTHER PUBLICATIONS

Notice of Allowance corresponding to Korean Application No. 2008-018063046, filed Mar. 31, 2008.

* cited by examiner

*Primary Examiner* — Edward Glick
*Assistant Examiner* — David Chung
(74) *Attorney, Agent, or Firm* — Knobbe, Martens, Olson & Bear, LLP

(57) ABSTRACT

An organic light emitting display device includes an organic light emitting display panel; a bezel frame comprising a lower surface and side walls and receiving the display panel; a bezel receiving the bezel frame; and a connecting system connecting the bezel frame and the bezel.

19 Claims, 8 Drawing Sheets

ORGANIC LIGHT EMITTING DISPLAY DEVICE

CROSS-REFERENCE TO RELATED APPLICATIONS

This application claims the benefit of Korean Patent Application No. 10-2007-0050322, filed on May 23, 2007 in the Korean Intellectual Property Office, the disclosure of which is incorporated herein by reference.

BACKGROUND

1. Technical Field

This disclosure relates generally to an organic light emitting display panel, and more particularly to an organic light emitting display device comprising a bezel and bezel frame that reduces stress on an organic light emitting display device.

2. Discussion of Related Art

Organic light emitting display devices are widely used and have relatively simple structures. A typical organic light emitting display device has a structure comprising at least one organic film layer, including a light emitting layer, interposed between a first electrode and a second electrode. The first electrode is formed on a substrate and functions as an anode, injecting holes into the organic film. On the organic film opposite to the first electrode is formed the second electrode, which functions as a cathode for injecting electrons into the organic film.

A display panel of an organic light emitting display device generally uses a glass substrate, which can be deformed and broken by external impacts. In smaller and thinner displays, the rigidity of the display panel is reduced, thereby increasing the possibility of deformation and breakage.

SUMMARY OF THE INVENTION

It is an object to provide an organic light emitting display device with reduced stress transmitted to an organic light emitting display panel. Some embodiments provide an organic light emitting display device including: an organic light emitting display panel; and a bezel frame configured with a lower surface and side walls and receiving the display panel. The organic light emitting display device includes a bezel receiving the bezel frame; and a connecting system connecting the bezel frame and the bezel.

Preferably, the connecting system includes a projecting part formed on the side walls of the bezel frame and a depressed part formed on the inner side of the bezel corresponding to the projecting part. In some embodiments, the connecting means can include the projecting part formed in the side walls of the bezel frame and a through-hole formed in the inner side of the bezel corresponding to the projecting part. Some embodiments comprise a plurality of projecting parts. In some embodiments, the projecting part may be formed on an opposite side a side wall from the display panel in the bezel frame. The bezel can include the lower surface, the side walls, and an upper surface formed in a region corresponding to at least one non-pixel region of the display panel by being extended from at least one of the side walls, the upper surface of the bezel can correspond to a non-pixel region of the display panel, the side walls of the bezel can extend in an orthogonal direction from the lower surface of the bezel, and the upper surface of the bezel can extend in an orthogonal direction from the side walls of the bezel. The bezel can include a lower surface and side walls extending from edges of the lower surface, and the side walls of the bezel frame can correspond to three sides of the display panel. The side walls of the bezel correspond to the four sides of the display panel, wherein a height of one side wall can be lower than a height of the display panel. Between the display panel and the bezel frame can further be included an adhesion member, and on the display panel can further be included a polarizing plate. The seal may comprise an inorganic sealant, and the bezel and the bezel frame may comprise at least one of stainless steel (STS), magnesium, and magnesium alloy.

Some embodiments provide an organic light emitting display device comprising: an organic light emitting display panel; a bezel frame comprising a lower surface and a plurality of side walls defining a receiving space in which the display panel is received; a bezel receiving the bezel frame; and a connecting system coupling the bezel frame and the bezel.

In some embodiments, the connecting system comprises at least one projection formed on at least one side wall of the bezel frame and at least one depression corresponding to the at least one projection formed on an inner side of the bezel. Some embodiments comprise a plurality of projections. In some embodiments, the at least one projection is formed on a side of a side wall opposite from the receiving space in which the display panel is received.

In some embodiments, the connecting system comprises at least one projection formed on at least one side wall of the bezel frame and a through-hole corresponding to the at least one projection formed in the bezel.

In some embodiments, the bezel comprises a lower surface, a plurality of side walls, and at least one upper surface extending from at least one side wall over a region corresponding to at least a portion of a non-pixel region of the display panel. In some embodiments, the at least one upper surface of the bezel extends over a region corresponding to the non-pixel region of the display panel. In some embodiments, the plurality of side walls of the bezel extend orthogonally from the lower surface of the bezel. In some embodiments, the at least one upper surface of the bezel extends orthogonally from the at least one side wall of the bezel.

In some embodiments, the bezel comprises a lower surface and a plurality of side walls extending from edges of the lower surface. In some embodiments, the plurality of side walls of the bezel frame correspond to three sides of the display panel. In some embodiments, the plurality of side walls of the bezel correspond to four sides of the display panel, wherein a height of one side wall lower than a height of the display panel.

Some embodiments further comprise an adhesion member disposed between the display panel and the bezel frame. Some embodiments further comprise a polarizing plate disposed on the display panel.

In some embodiments, the display panel comprises a seal comprising an inorganic sealant. In some embodiments, the bezel and the bezel frame each independently comprise at least one of stainless steel (STS), magnesium, and magnesium alloy.

Some embodiments provide an organic light emitting display device comprising: a bezel frame comprising a lower surface and a plurality of side walls, wherein the lower surface and the plurality of sides define a receiving space; an organic light emitting display panel inserted in the receiving space; a bezel comprising a lower surface, and a plurality of side walls, dimensioned and configured receive the bezel frame therein; at least one projection formed one of the bezel and the bezel frame; and at least one depression formed on the other of the bezel and the bezel frame. The bezel frame is slidably insertable into the bezel with the bottom surface of the bezel frame contacting the bottom surface of the bezel and at least some of the plurality of side walls of the bezel frame contacting at least some of the plurality of side walls of the bezel, and when the bezel frame is slidably inserted into the bezel, the at least one projection engages the at least one depression.

In some embodiments, the bezel frame is slidably insertable in the bezel from above the bezel. In some embodiments, the bezel frame is slidably insertable in the bezel from a side of the bezel.

In some embodiments, the at least one depression comprises a through hole.

BRIEF DESCRIPTION OF THE DRAWINGS

These and/or other aspects and advantages will become apparent and more readily appreciated from the following description of exemplary embodiments, taken in conjunction with the accompanying drawings of which.

DETAILED DESCRIPTION OF EXEMPLARY EMBODIMENTS

Hereinafter, certain embodiments will be described with reference to the accompanying drawings. The following embodiments are provided to help the understanding those skilled in the art and can be varied in various ways. Accordingly, the scope of the present disclosure is not limited to the embodiments as will be described below.

Deformation and breakage of a display panel are reduced by mounting the display panel in a bezel, protecting a surface of the display panel. Hereinafter, an embodiment of an organic light emitting display device received in a bezel is described in more detail.

Figure 1:
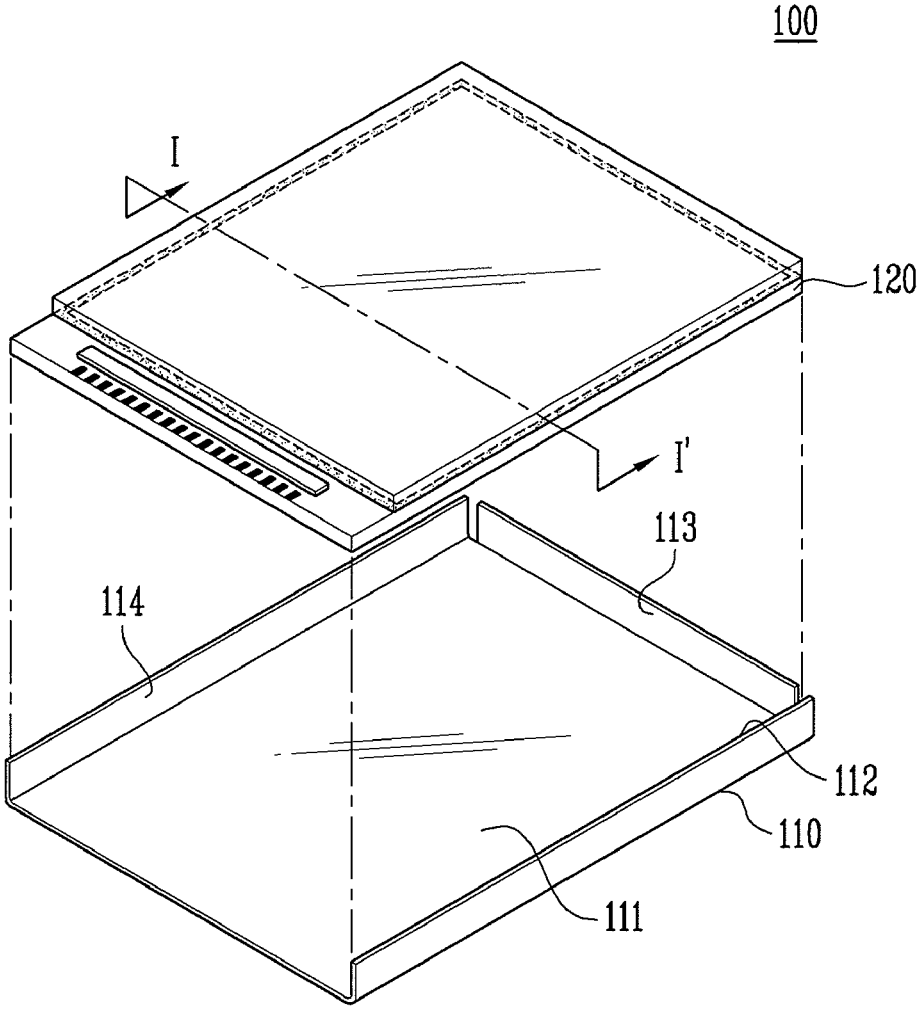
FIG. 1 is an exploded perspective view schematically showing an embodiment of organic light emitting display device.
Figure 2:
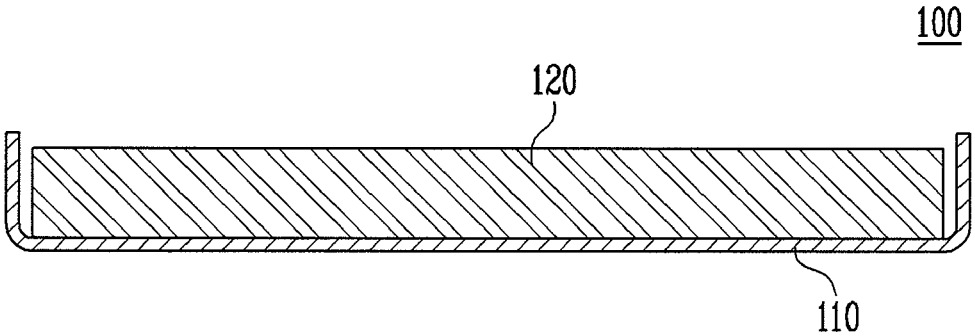
FIG. 2 is a cross-sectional view taken along section I-I' of FIG. 1.

FIG. 1 is an exploded perspective view schematically showing an embodiment of an organic light emitting display device 100. FIG. 2 is a cross-sectional view taken along section I-I' FIG. 1. Referring to FIGS. 1 and 2, the organic light emitting display device 100 includes a display panel 120 and a bezel 110. The display panel 120 includes a first substrate on which an organic light emitting element is formed, a second substrate disposed above the first substrate, and a seal for bonding the first substrate to the second substrate. The bezel 110 reinforces the display panel 120. The bezel 110 comprises a lower surface 111 and a plurality of side walls 112, 113, and 114 extending from edges of the lower surface 111. A receiving space for the display panel 120 is formed by the lower surface 111 and the side walls 112, 113, and 114 of the bezel 110. When received in the bezel 110, the first substrate of the display panel 120 corresponds to the lower surface 111 of the bezel 110, and the sides of the display panel 120 correspond to the side walls 112, 113, and 114 of the bezel.

In the illustrated embodiment, the side walls 112, 113, and 114 of the bezel 110 extend in an orthogonal direction from the lower surface 111 of the bezel 110. However, because the organic light emitting display panel 120 is formed on a glass substrate, the display panel can easily be deformed and broken by even a small impact.

Figure 3:
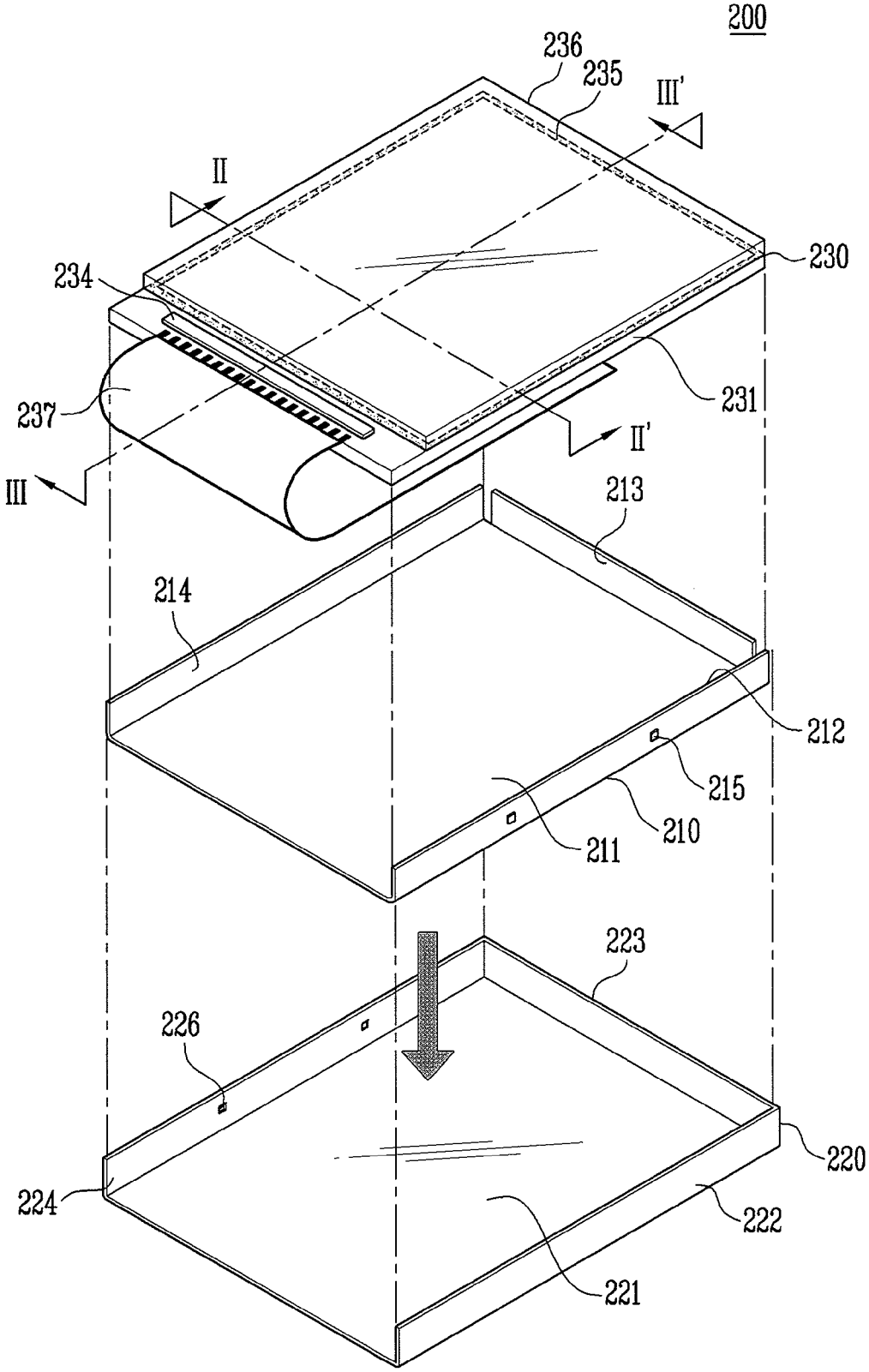
FIG. 3 is an exploded perspective view schematically showing an embodiment of an organic light emitting display device.
Figure 4:
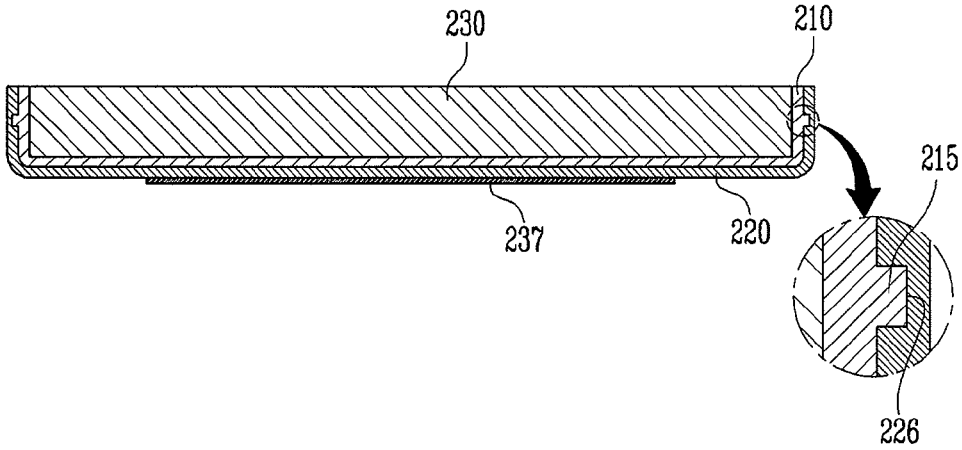
FIG. 4 is a cross-sectional view taken along section II-II' of FIG. 3.
Figure 5:
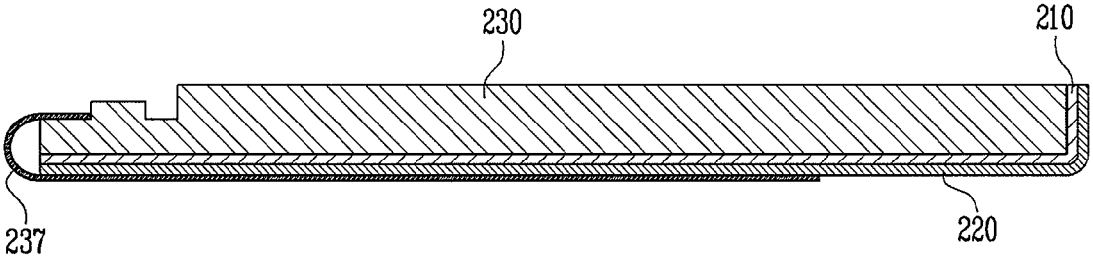
FIG. 5 is a cross-sectional view taken along section III-III' of FIG. 3.

FIG. 3 is an exploded perspective view schematically showing an embodiment of an organic light emitting display device 200. FIG. 4 is a cross-sectional view taken along section II-II' of FIG. 3. FIG. 5 is a cross-sectional view taken along section III-III' of FIG. 1.

Referring to FIGS. 3 to 5, the organic light emitting display device 200 comprises an organic light emitting display panel 230; a bezel frame 210 comprising a lower surface 211, and side walls 212, 213, and 214, and receiving the display panel 230; and a bezel 220 receiving the bezel frame 210. The bezel 220 includes a lower surface 221 and side walls 222, 223, and 224 extending from edges of the lower surface 221.

The display panel 230 includes a first substrate 231 on which an organic light emitting element is formed, a second substrate 236 disposed over the first substrate 231, and a seal 235 sealing the first substrate 231 and the second substrate 236.

The first substrate 231 includes a pixel region, where the organic light emitting element is formed, and a non-pixel region. The pixel region is provided with scan lines and data lines, and organic light emitting elements coupled between the scan lines and the data lines in a matrix to form pixels. The non-pixel region is the entire region of the first substrate 231 other than the pixel region. The non-pixel region is provided with scan lines and data lines extending from the scan lines and data lines of the pixel region; a power supply line for operating the organic light emitting elements; and a scan driver and a data driver for processing external signals supplied from a pad unit 234.

The organic light emitting element comprises an anode electrode, a light emitting layer, and a cathode electrode. When a predetermined voltage is applied between the anode electrode and the cathode electrode, holes injected through the anode electrode and electrons injected through the cathode electrode are recombined in the light emitting layer, thereby emitting light therefrom.

The pad unit 234 is coupled to a flexible printed circuit 237 (FPC) in a film form, wherein the FPC 237 is exposed along a lower surface of the bezel 220. The power supply voltage, the scan signal, and the data signal can be supplied to the organic light emitting elements through the externally exposed FPC 237.

The second substrate 236 protects the organic light emitting element formed on the first substrate 231 from oxygen and moisture. A seal 235 is formed between the first substrate 231 and the second substrate 236 to bond the first substrate 231 and the second substrate 236 and/or to form an airtight seal therebetween. In the illustrated embodiment, the seal 235 is formed along the circumference of the organic light emitting element. The seal 235 can use various materials such an inorganic sealant and/or an organic sealant, etc. Preferably, the seal 235 can be formed of frit, which is an inorganic material. For example, the frit can be formed from at least one of $K_2O$, $Fe_2O_3$, $Sb_2O_3$, ZnO, $P_2O_5$, $V_2O_5$, $TiO_2$, $Al_2O_3$, $B_2O_3$, $WO_3$, SnO, and PbO.

On the display panel 230 can be attached a polarizing plate (not shown) for reducing external light reflection.

In order to reinforce the display panel 230, the display panel 230 is received inside the bezel frame 210. The display panel 230 can be received in the inside of the bezel frame 210 as an insert and can be fixed in the bezel frame 210 by an adhesion member on the lower surface 211 of the bezel frame 210. For example, the adhesion member can be formed of at least one of a vinyl tape or an adhesive.

More specifically describing of the bezel frame 210, the bezel frame 210 comprises the lower surface 211 and the plurality of side walls 212, 213, and 214 extending from edges of the lower surface 211. The bezel frame 210 forms a receiving space for the display panel 230 defined by the lower surface 211 and the side walls 212, 213, and 214. The lower surface 211 of the bezel frame 210 corresponds to the lower surface of the display panel 230 and the side walls 212, 213, and 214 of the bezel frame 210 correspond to the sides of the display panel 230. The bezel frame 210 prevents the stress applied to the bezel 220 from being transferred to the display panel 230. Also, the bezel frame 210 reinforces the display panel 230 and can be formed of at least one of stainless steel STS, magnesium, and magnesium alloy, which have high absorption rates.

Meanwhile, in order to prevent the display panel 230 from being deformed and broken from external impacts, the bezel frame 210 receiving the display panel 230 is, in turn, received inside the bezel 220.

The bezel 220, the bezel frame 210 including the display panel 230 can be slidably inserted into the bezel 220 and secured therein using a connecting system. The bezel frame 210 is received in the bezel 220 by sliding from an upper direction through the open top as indicated by the direction of the arrow (→), as shown in FIG. 3. The connecting system includes a projection or projecting part 215 formed on the side walls 212 and 214 of the bezel frame 210 and a depression or depressed part 226 formed in the inner sides of the side walls 222 and 224 of the bezel 220. More specifically, at least one projection 215 is formed in the side walls 212 and 214 of the bezel frame 210, opposite in direction from the receiving space of the bezel frame 210 in which the display panel 230 is received, and at least one depression 226 is formed in the side walls 222 and 224 of the bezel 220 in positions corresponding to the positions of the projections 215. The projection 215 can be formed in various forms, and in the embodiment illustrated in FIG. 4, is formed in a square form or cross section for convenience of explanation. Also, the depression 226 is a groove receiving the projection 215, and can be formed in the same form as the projection.

The projection 215 and the depression 226 prevent the separation of the bezel frame 210 from the inside of the bezel 220. In other words, when the bezel frame 210 is received in the bezel 220, the projection 215 of the bezel frame 210 is coupled to the depression 226 of the bezel 220 to prevent the bezel frame 210 from separating from the bezel 220. Also, the bezel frame 210 is slidably inserted in the interior of the bezel 220 so that the space between the side walls 212, 213, and 214 of the bezel frame 210 and the side walls 222, 223, and 224 of the bezel 220 is reduced, thereby reducing shaking of the display panel 230 as illustrated in FIGS. 4 and 5.

Specifically describing the shape of the bezel 220, the bezel 220 comprises the lower surface 221 and the plurality of the side walls 222, 223, and 224 extending from edges of the lower surface 221. For example, the side walls 222, 223, and 224 of the bezel 220 extend in an orthogonal direction from the lower surface 221 of the bezel 220 so that they correspond to the side walls 212, 213, and 214 of the bezel frame 210, respectively. Also, the bezel 220 can be formed with four side walls, each extending from one of the four edges of the lower surface 211. In the illustrated embodiment, the height of the fourth side wall can be different from the heights of other side walls. That is, the height of the fourth side wall is about equal to or lower than the height of the first substrate 231 of the display panel 230 so that the FPC 237 can be easily coupled to the pad unit 234, making it possible to protect every side of the display panel 230.

In review, the bezel frame 210 is received in the bezel 220 with the lower surface 221 of the bezel 220 corresponding to the lower surface 211 of the bezel frame 210 and the side walls 222, 223, and 224 of the bezel 220 corresponding to the side walls 212, 213, and 214 of the bezel frame 210.

Such a bezel 220 can be formed of the same material as the bezel frame 210. The bezel frame 210 and the bezel 220 can be manufactured by bending a sheet of a material comprising at least one of stainless steel STS, magnesium, and magnesium alloy; or by an injection molding process. Also, the side walls 222, 223, and 224 of the bezel 220, and the side walls 212, 213, and 214 of the bezel frame 210 are integrally formed, or separately formed and then assembled with the lower surface 221 of the bezel 220 or the lower surface 211 of the bezel frame 220, respectively.

As such, the bezel 220 is formed to contact the lower surface 211 and the side walls 212, 213, and 214 of the bezel frame 210 receiving the display panel 230, thereby protecting the display panel 230 from external pressure and impact.

Figure 6:
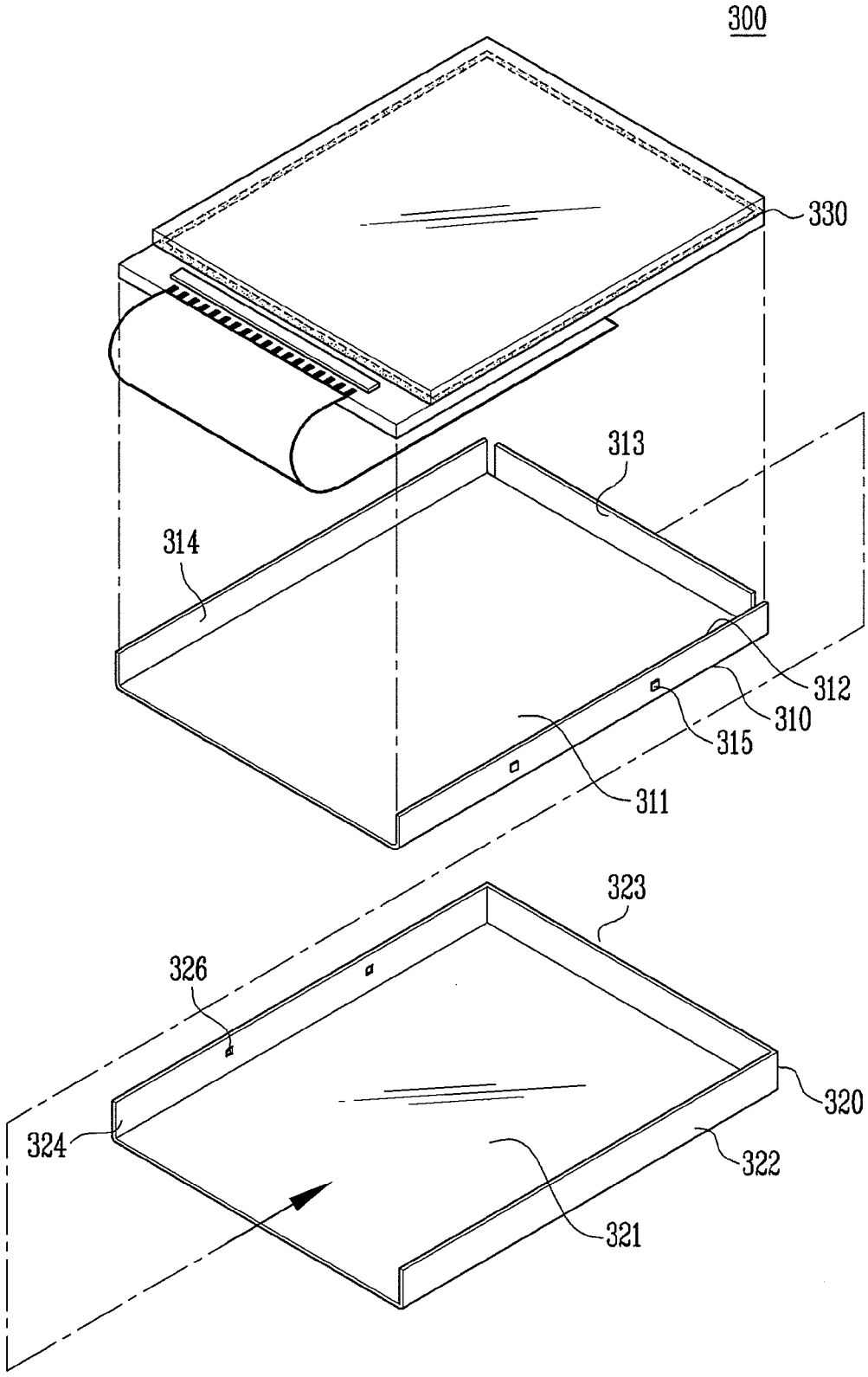
FIG. 6 is an exploded perspective view schematically showing another embodiment of an organic light emitting display device.

FIG. 6 is an exploded perspective view schematically showing an organic light emitting display device according to another embodiment. Referring to FIG. 6, an organic light emitting display device 300 comprises an organic light emitting display panel 330; a bezel frame 310 formed of a lower surface 311 and side walls 312, 313, 314, and receiving the display panel 330; and a bezel 320 receiving the bezel frame 310, wherein the bezel 320 includes a lower surface 311 and side walls 322, 323, and 324 extending from edges of the lower surface 321.

The second embodiment is generally similar to the first embodiment; however, the second embodiment allows the bezel frame 310 to be received in the bezel 320 by sliding the bezel frame 310, including the display panel 330, sideways from a direction of the bezel 320 in which a side wall is not formed, in the direction indicated by the arrow (→) shown in FIG. 6.

Also, a connecting system includes a projections 315 formed on the outer sides of the walls 312 and 314 of the bezel frame 310, and a depressions 326 formed in the inner sides of the side walls 322 and 324 of the bezel 320.

Figure 7:
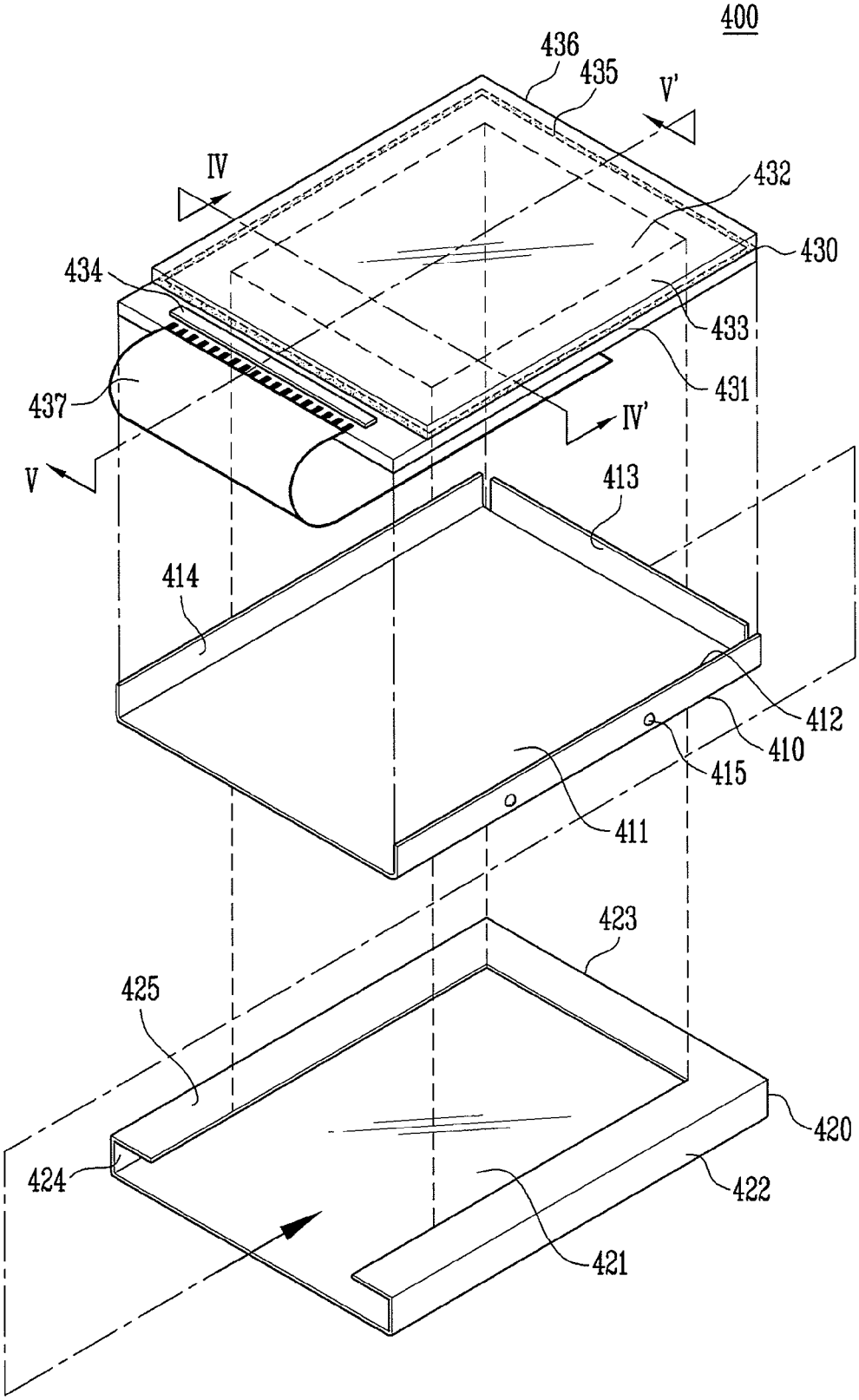
FIG. 7 is an exploded perspective view schematically showing another embodiment of an organic light emitting display device.
Figure 8:
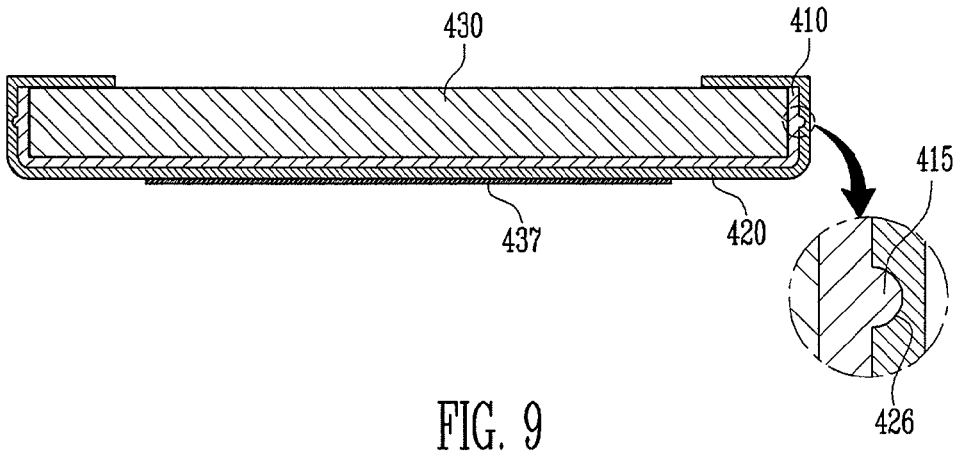
FIG. 8 is a cross-sectional view taken along section IV-IV' of FIG. 7.
Figure 9:
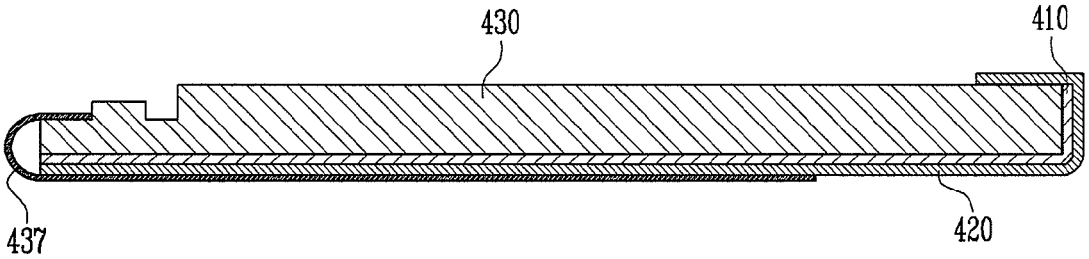
FIG. 9 is a cross-sectional view taken along section V-V' of FIG. 7.

FIG. 7 is an exploded perspective view schematically showing an organic light emitting display device 400 according to another embodiment, FIG. 8 is a cross-sectional view taken along section IV-IV' of FIG. 7, and FIG. 9 is a cross-sectional view taken along section V-V' of FIG. 7.

Referring to FIGS. 7 to 9, an organic light emitting display device 400 includes a display panel 430, comprising a pixel region 432, where an organic light emitting element is formed, and a non-pixel region 433; a bezel frame 410 comprising a lower surface 411 and side walls 412, 413, and 414, and receiving the display panel 430; and a bezel 420 receiving the bezel frame 410, wherein the bezel 420 includes a lower surface 421, side walls 422, 423, and 424, and an upper surface 424 formed in a region corresponding to at least a portion of the non-pixel region of the display panel 430 and extending from the side walls 422, 423, and 424.

The display panel 430 includes a first substrate 431 on which an organic light emitting element is formed, a second substrate 436 disposed over the first substrate 431, and a seal 435 sealing the first substrate 431 and the second substrate 436.

The first substrate 431 includes the pixel region 432, where the organic light emitting element is formed, and the non-pixel region 433. The pixel region 432 comprises scan lines and data lines, and organic light emitting elements coupled between the scan lines and the data lines in a matrix to form pixels.

The non-pixel region 433 is the entire region of the first substrate 431 other than the pixel region 432, and comprises scan lines and data lines extending from scan lines and data lines in the pixel region, a power supply line for operating the organic light emitting elements, and a scan driver and a data driver for processing signals supplied from the external pad unit 434 and supplying the signals to the scan lines and the data lines.

The pad unit 434 is coupled to a flexible printed circuit 437 (FPC) in a film form, wherein the FPC 437 is exposed to the exterior of the display device 400 along the lower surface of the bezel 420. The organic light emitting element can be supplied with the power supply voltage, the scan signal, and the data signal through the FPC 437.

The second substrate 436 protects the organic light emitting element formed on the first substrate 431 from oxygen and moisture. A seal 435 formed between the first substrate 431 and the second substrate 436, bonding the first substrate 431 and the second substrate 436 and/or forming an airtight seal therebetween. In the illustrated embodiment, the seal 435 is formed around the circumference of the organic light emitting element. The seal 435 can comprise various materials such an inorganic sealant and/or an organic sealant, etc. Preferably, it can be formed of frit, which is an inorganic material.

On the display panel 430 can be attached a polarizing plate (not shown) for controlling external light reflection.

In order to reinforce the strength of the display panel 430, the display panel 430 is received in the inside of the bezel frame 410. The display panel 430 is inserted into the inside of the bezel frame 410, and can be fixed in the bezel frame 410 by further forming an adhesion member on the lower surface 411 of the bezel frame 410. The adhesion member can be formed of at least one of a vinyl tape and/or an adhesive.

More specifically describing of the bezel frame 410, the bezel frame 410 is formed of the lower surface 411 and the plurality of side walls 412, 413, and 414 extending from edges of the lower surface 411. The bezel frame 410 forms a receiving space for the display panel 430 defined by the lower surface 411 and the side walls 412, 413, and 414. The lower surface 411 of the bezel frame 410 corresponds to the lower surface of the display panel 430, and the side walls 412, 413, and 414 of the bezel frame 410 correspond to the sides of the display panel 430. The bezel frame 410 prevents stress applied to the bezel 420 from being transferred to the display panel 430, and is formed in a shape surrounding the lower surface and the sides of the display panel. Also, the bezel frame 410 reinforces the display panel 430 and can be formed of at least one of stainless steel STS, magnesium, and magnesium alloy, which have high absorption rates.

Meanwhile, in order to prevent the display panel 430 from being deformed and broken from external impacts, the bezel frame 410 receiving the display panel 430 is received in the inside of the bezel 420.

In order to allow the bezel frame, including the display panel 430, to be received in the bezel 420, the bezel frame 410 can be inserted in the bezel 420 in a sliding manner using a connecting system. The bezel frame 410 is inserted by sliding into the bezel 420 from an open direction of the bezel 420 where no side wall is formed, as shown by the arrow (→) in FIG. 7.

The connecting system includes projections 415 formed on outer sides of the side walls 412 and 414 of the bezel frame 410, and depressions 426 formed in the inner portions of the side walls 422 and 424 of the bezel 420. More specifically, a plurality of projections 415 are formed on the side walls 412 and 414 of the bezel frame 410 in opposite direction from the region in which the display panel 430 is received, with the depressions 426 formed in the side walls 422 and 424 of the bezel 420 in positions corresponding to the positions of the projections 415. The projections 415 can be formed in various profiles, and in the illustrated embodiment, are formed with a round profile for convenience of explanation. Also, the depression 426 is formed as a groove receiving the projection 415, and can be formed as a groove with the same profile as the projection 415.

The projection 415 and the depression 426 prevent the separation of the bezel frame 410 from the inside of the bezel 420. In other words, when the bezel frame 410 is slidably inserted in the bezel 420, the projection 415 of the bezel frame 410 is coupled to the depression 426 formed in the bezel 420 to prevent the separation of the bezel frame 410 from the bezel 420. Also, the bezel frame 410 is inserted inside the bezel 420 in a sliding manner so that space between the side walls 412, 413, and 414 of the bezel frame 410 and the side walls 422, 423, and 424 of the bezel 420 is reduced, making it possible to prevent shaking of the display panel 430.

Specifically describing the shape of the bezel 420, the bezel 420 is formed of the lower surface 421 and the plurality of the side walls 422, 423, and 424 extending from edges of the lower surface 421, and an upper surface 425 extending inwardly from an edge of at least one of the plurality of the side walls 422, 423, and 424, and corresponding to at least a portion of the non-pixel region 433 of the display panel 430.

In the illustrated embodiment, the upper surface 425 of the bezel 420 is formed only in regions corresponding to the non-pixel region 433 in order to prevent interference of light emitted from the pixel region of the display panel 430.

For example, the side walls 422, 423, and 424 of the bezel 420 extend in an orthogonal direction to the lower surface 421 of the bezel 420 so that they correspond to the side walls 412, 413, and 414 of the bezel frame 410, and the upper surface 425 of the bezel 420 extends from the edges of the side walls 422, 423, and 424 of the bezel 420 over a region corresponding to the non-pixel region 433 of the display panel 430.

Reviewing, the bezel frame 410 received inside of the bezel 420 so that the lower surface 421 of the bezel 420 corresponds to the lower surface 411 of the bezel frame 410; the side walls 422, 423, and 424 of the bezel 420 correspond to the side walls 412, 413, and 414 of the bezel frame 410; and the upper surface 425 of the bezel 420 corresponds to a non-pixel region 433 of the display panel 430.

Such a bezel 420 can be formed of the same material as the bezel frame 410. The bezel frame 410 and the bezel 420 can be manufactured by bending a sheet of at least one of stainless steel STS, magnesium, and magnesium alloy, or by injection molding. Also, the side walls 422, 423, and 424 of the bezel 420, the upper surface 425 of the bezel 420, or the side walls 412, 413, and 414 of the bezel frame 410 are mutually coupled to the lower surface 421 of the bezel 420 or the lower surface 411 of the bezel frame 420, respectively, integrally or assembled from separate components.

As such, the bezel 420 is a closed structure surrounding the lower surface 411, the side walls 412, 413, and 414, and the upper surface of the bezel frame 410 receiving the display panel 430, thereby protecting the lower surface, the sides, and the upper surface (upper edge region) of the display panel 430 from external pressure and impact. Also, since the bezel 420 includes the upper surface 425 corresponding to at least a portion of the non-pixel region 433 of the display panel 430, the upper edge regions of the display panel 430 that are vulnerable to electrostatic discharge (ESD), etc can be protected from the ESD.

Figure 10:
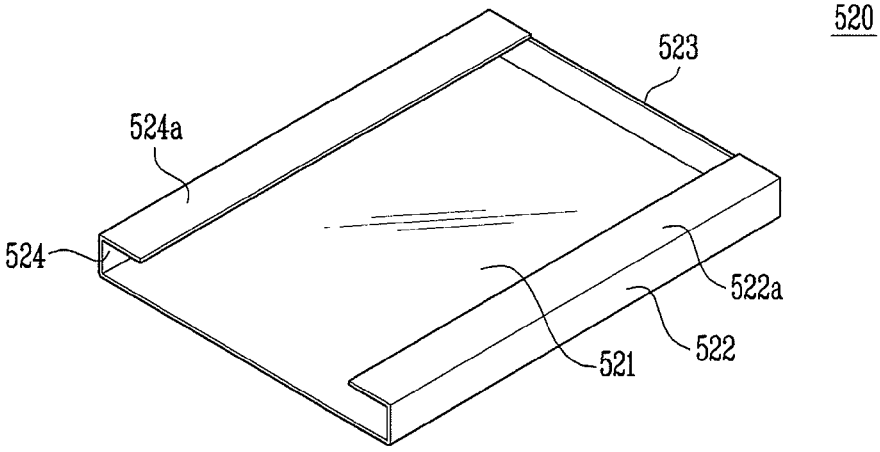
FIG. 10 is a perspective view showing an embodiment of a bezel.

FIG. 10 is an exploded perspective view showing an embodiment of a bezel 520. Referring to FIG. 10, the bezel 520 includes a lower surface 521, a plurality of side walls 522, 523, and 524 extending orthogonally from the lower surface 521, and upper surfaces 522*a* and 524*a* extending from at least one of the plurality of side walls 522, 523, and 524. In the illustrated embodiment, the upper surfaces 522*a* and 524*a* extend orthogonally from the edges of a first side wall 522 and a third side wall 524 of the plurality of side walls 522, 523, and 524 and parallel with the lower surface 521. Also, the upper surfaces 522*a* and 524*a* of the bezel 520 are disposed in at least a region corresponding to the non-pixel region of the display panel, thereby protecting the top and upper edge regions of the display panel.

The lower surface, the side walls 522, 523, and 524, and the upper surface 522*a* and 524*a* of the bezel 520 can form a bar-shaped cross section, with the ends of the bar having a circular cross section or a square cross section.

Figure 11:
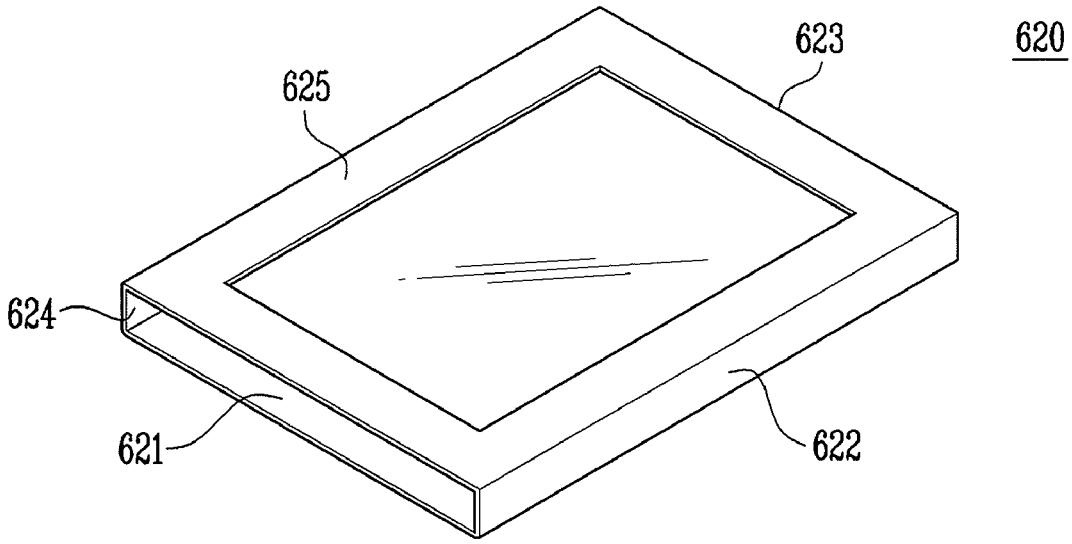
FIG. 11 is a perspective view showing another embodiment of a bezel.

FIG. 11 is an exploded perspective view showing another embodiment of a bezel 620. Referring to FIG. 11, the bezel 620 includes a lower surface 621, a plurality of side walls 622, 623, and 624 extending orthogonally from edges of the lower surface 621, and upper surface 625 extending from edges of the plurality of side walls 622, 623, and 624 and corresponding to the non-pixel region of the display panel. In the illustrated embodiment, the upper surface 625 extends orthogonally from first, second, and third side walls 622, 623, and 624, and over the entire non-pixel region of the display panel. Also, the upper surface 625 of the bezel 620 forms an opening over the pixel region of the display panel received inside of the bezel 620, thereby not interfering with light emitted from the pixel region.

Figure 12:
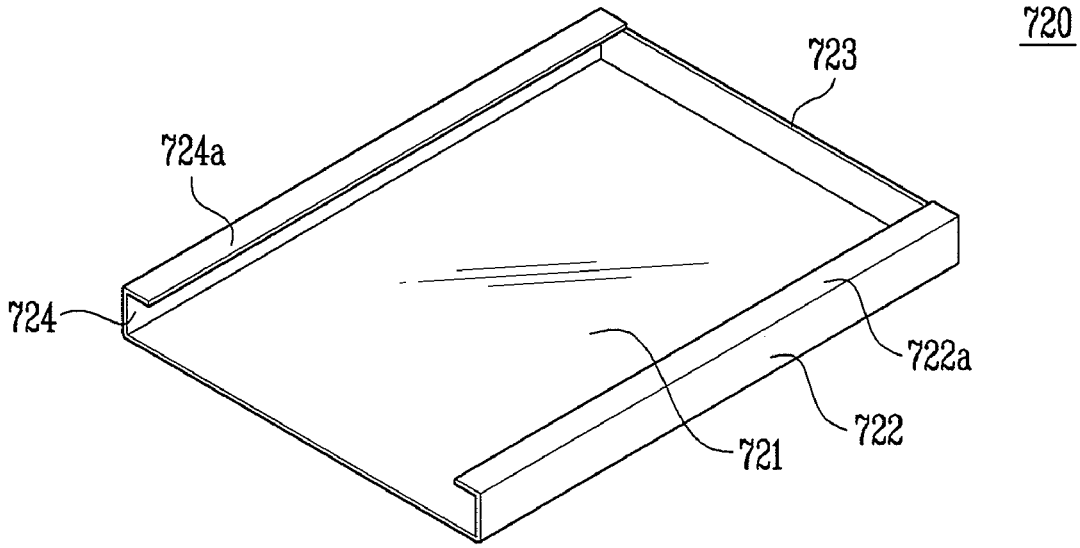
FIG. 12 is a perspective view showing another embodiment of a bezel.

FIG. 12 is an exploded perspective view showing another embodiment of a bezel 720. Referring to FIG. 12, the bezel 720 includes a lower surface 721, a plurality of side walls 722, 723, and 724 extending orthogonally from the lower surface 721, and upper surfaces 722*a* and 724*a* extending from at least one of the plurality of side walls 722, 723, and 724. The upper surfaces 722*a* and 724*a* extend orthogonally from the edges of the first side wall 722 and the third side wall 724, respectively, over the upper edge region of the display panel.

Figure 13:
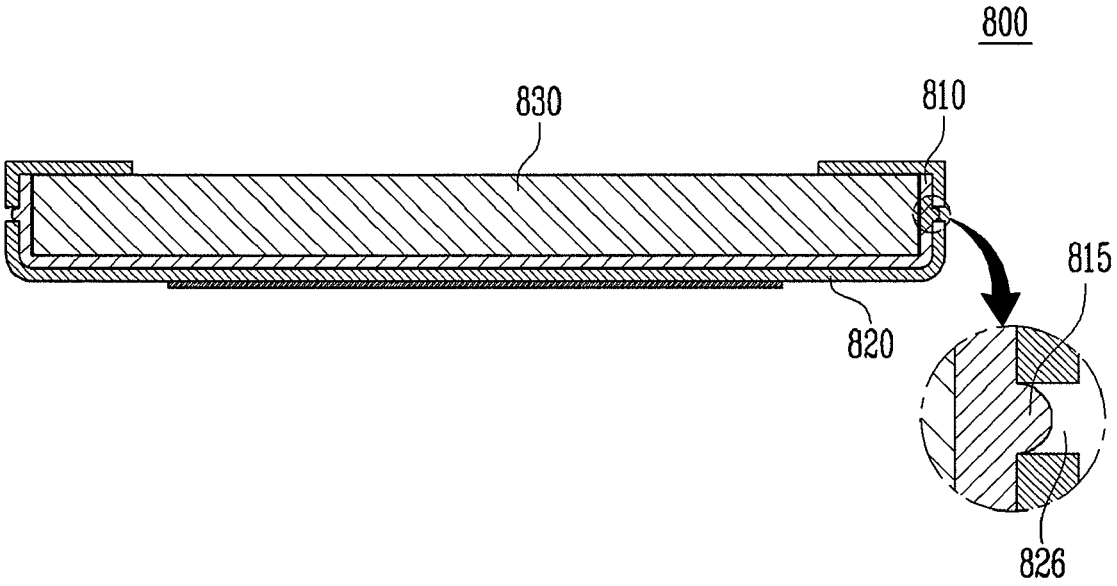
FIG. 13 is a cross-sectional view showing an embodiment of a connecting system between a bezel frame and a bezel.

FIG. 13 is a cross-sectional view showing a connecting system of a bezel frame and a bezel. Referring to FIG. 13, an organic light emitting display device 800 includes a display panel 830 including a pixel region, where at least one organic light emitting element is formed, and a non-pixel region; a bezel frame formed of a lower surface and side walls and receiving the display panel; and a bezel 820 receiving the bezel frame 810, wherein the bezel 820 includes a lower surface, side walls, and an upper surface extending from at least one of the side walls over a region corresponding to a non-pixel region of the display panel 830.

The connecting system in the illustrated embodiment is the same as in the embodiment illustrated in FIGS. 7-9 and described above, and comprises a through-hole 826 in the bezel 820 corresponding to a projection 815. More specifically, a plurality of projections 815 are formed on the side walls of the bezel frame 810, opposite from a receiving space for the display panel 830, and a plurality of through-holes 826 corresponding in number to the projections 815 are formed in the bezel 820.

Each through-hole 826 is dimensioned and configured for receiving a corresponding projection 815, and consequently, has a similar profile as the projection 815. In the illustrated embodiment, the through-hole 826 comprises a hole with a square profile. In other words, the projection 815 of the bezel frame 810 is inserted into the through-hole 826 formed on the side wall of the bezel 820, thereby coupling the bezel frame 810 and the bezel 820.

As discussed above, an organic light emitting display device includes a bezel frame protecting the organic light emitting display panel, making it possible to reduce stresses applied to the organic light emitting display panel. Also, the bezel frame can be slidably inserted into a bezel, and coupled to the bezel without using an adhesion member.

Embodiments of the bezel include an upper surface corresponding to a non-pixel region of the display panel, making it possible to protect the top and the upper edges of the display panel. Also, in a bezel including an upper surface, the upper edge region of the display panel that is vulnerable to electrostatic discharge (ESD), etc can be protected from the ESD.

Although certain embodiments have been shown and described, it would be appreciated by those skilled in the art that changes might be made without departing from the principles and spirit of the disclosure, the scope of which is defined by the claims and their equivalents.

What is claimed is:

1. An organic light emitting display device comprising:
an organic light emitting display panel;
a bezel frame comprising a continuous lower surface and a plurality of side walls defining a receiving space in which the display panel is received;
a bezel receiving the bezel frame and comprising a lower surface, a plurality of side walls, and at least one upper surface extending from at least one side wall; and
a connecting system coupling the bezel frame and the bezel,
wherein the bezel frame is slidably insertable in the bezel, and
the lower surface of the bezel frame contacting the lower surface of the bezel, and at least some of the plurality of side walls of the bezel frame contacting at least some of the plurality of side walls of the bezel, respectively.

2. The organic light emitting display device of claim 1, wherein the connecting system comprises at least one projection formed on at least one side wall of the bezel frame and at least one depression corresponding to the at least one projection formed on an inner side of the bezel.

3. The organic light emitting display device of claim 2, comprising a plurality of projections.

4. The organic light emitting display device of claim 2, wherein the at least one projection is formed on a side of a side wall opposite from the receiving space in which the display panel is received.

5. The organic light emitting display device of claim 1, wherein the connecting system comprises at least one projection formed on at least one side wall of the bezel frame and a through-hole corresponding to the at least one projection formed in the bezel.

6. The organic light emitting display device of claim 1, wherein the at least one upper surface of the bezel extends over a region corresponding to the non-pixel region of the display panel.

7. The organic light emitting display device of claim 1, wherein the plurality of side walls of the bezel extend orthogonally from the lower surface of the bezel.

8. The organic light emitting display device of claim 1, wherein the at least one upper surface of the bezel extends orthogonally from the at least one side wall of the bezel.

9. The organic light emitting display device of claim 1, wherein the bezel comprises a lower surface and a plurality of side walls extending from edges of the lower surface.

10. The organic light emitting display device of claim 9, wherein the plurality of side walls of the bezel frame correspond to three sides of the display panel.

11. The organic light emitting display device of claim 9, wherein the plurality of side walls of the bezel correspond to four sides of the display panel, wherein a height of one side wall lower than a height of the display panel.

12. The organic light emitting display device of claim 1, further comprising an adhesion member disposed between the display panel and the bezel frame.

13. The organic light emitting display device of claim 1, further comprising a polarizing plate disposed on the display panel.

14. The organic light emitting display device of claim 1, wherein the display panel comprises a seal comprising an inorganic sealant.

15. The organic light emitting display device of claim 1, wherein the bezel and the bezel frame each independently comprise at least one of stainless steel (STS), magnesium, and magnesium alloy.

16. An organic light emitting display device comprising:

a bezel frame comprising a continuous lower surface and a plurality of side walls, wherein the lower surface and the plurality of sides define a receiving space;

an organic light emitting display panel inserted in the receiving space;

a bezel comprising a lower surface, and a plurality of side walls, dimensioned and configured receive the bezel frame therein;

at least one projection formed one of the bezel and the bezel frame; and at least one depression formed on the other of the bezel and the bezel frame, wherein the bezel frame is slidably insertable into the bezel with the bottom surface of the bezel frame contacting the bottom surface of the bezel and at least some of the plurality of side walls of the bezel frame contacting at least some of the plurality of side walls of the bezel, and when the bezel frame is slidably inserted into the bezel, the at least one projection engages the at least one depression.

17. The organic light emitting display device of claim 16, wherein the bezel frame is slidably insertable in the bezel from above the bezel.

18. The organic light emitting display device of claim 16, wherein the bezel frame is slidably insertable in the bezel from a side of the bezel.

19. The organic light emitting display device of claim 16, wherein the at least one depression comprises a through hole.

* * * * *